United States Patent [19]

Wiedmann

[11] Patent Number: 4,735,047

[45] Date of Patent: Apr. 5, 1988

[54] PISTON RODLESS WORKING CYLINDER

[75] Inventor: Hans P. Wiedmann, Munich, Fed. Rep. of Germany

[73] Assignee: Knorr-Bremse AC., Munich, Fed. Rep. of Germany

[21] Appl. No.: 864,405

[22] Filed: May 19, 1986

[30] Foreign Application Priority Data

Aug. 16, 1985 [DE] Fed. Rep. of Germany ..... 3529350

[51] Int. Cl.[4] ..... F25D 17/04

[52] U.S. Cl. ..... 60/415; 91/462

[58] Field of Search ..... 60/413, 415; 91/462; 901/22; 180/302

[56] References Cited

U.S. PATENT DOCUMENTS 3,018,627 1/1962 Perricci ..... 60/415 X 3,712,489 1/1973 Jamison ..... 60/415 X

FOREIGN PATENT DOCUMENTS 8331066 10/1983 Fed. Rep. of Germany .

*Primary Examiner*—William E. Wayner

*Attorney, Agent, or Firm*—Edmund M. Jaskiewicz

[57] ABSTRACT

A piston rodless working cylinder has a movable carriage upon which is mounted a compressed air driven device, such as, for example, a brake mechanism. The movable carriage is provided with a compressed air reservoir which can be recharged from a stationary compressed air source by pneumatic line connector devices which are automatically connected to the compressed air source in end positions of the carriage. This structure eliminates the necessity for flexible hose or line connections from a source of compressed air to the carriage.

10 Claims, 2 Drawing Sheets

PISTON RODLESS WORKING CYLINDER

The present invention relates to a piston rodless working cylinder, more particularly, to such a working cylinder having a power output element which carries a compressed air operated device, such as a braking mechanism, and mounted on a cylinder body both ends of which are closed by cylinder heads.

Such working cylinders are already known and may comprise steel band structures or slot cylinders as disclosed in DE-OS No. 34 03 830 in which contactless switching reed contacts are adjustably positioned on the cylinder body for actuation of the power output element which comprises a slidable carriage upon which is mounted the brake mechanism. These known working cylinders all require a flexible line connection from a stationary source of compressed air to the moving carriage in order to provide a supply of compressed air for the brake mechanism. During the operation of the working cylinder, this flexible line connection presents problems in that the line may become jammed or otherwise retained against movement, be damaged in other ways, or may incur leaks or even breakage. It would therefore be desirable if such a line connection in a working cylinder having a compressed air operated brake mechanism could be avoided.

In DE-GM 83 31 066 there is disclosed a piston rodless working cylinder having thereon auxilliary devices operated by compressed air and in which turning or gripping devices are provided. In an attempt to eliminate hoses from the compressed air supply, there is further disclosed telescopingly variable pipe connections extending from the moving carriage to a cylinder head. It would also be apparent to provide such telescoping-pipe connections also for the compressed air supply of a compressed air operated brake mechanism positioned on the carriage. However, these telescoping pipe connections need considerable space and are readily susceptible to damage with the result that jamming or leaking will occur.

It is therefore the principal object of the present invention to provide a piston rodless working cylinder having a novel and improved apparatus for supplying supressed air to the compressed air actuated device mounted on the carriage.

It is another object of the present invention to provide such a piston rodless working cylinder having an inexpensive, simple and reliable construction for supplying compressed air to the movable carriage on which a brake mechanism may be mounted.

The objects of the present invention are achieved and the disadvantages of the prior art are eliminated by providing a compressed air storage reservoir on the movable carriage or power output element and this reservoir is connectible by automatic, pneumatic coupler devices in the end positions of the carriage to the cylinder heads which in turn are connected to a source of compressed air.

It is particularly advantageous if the carriage has coupler devices on both sides thereof so that the reservoir in the carriage can be coupled to and charged from a source of compressed air in both end positions of the carriage.

According to one aspect of the present invention, a piston rodless working cylinder may comprise a cylinder body having two ends each of which is closed by a cylinder head which in turn is connected to a source of compressed air. A power output element is slidable on the cylinder body between end positions which are adjacent to cylinder heads and has a compressed air driven device thereon, which may be adapted for use as a brake mechanism. A compressed air reservoir in the power output element is automatically connected to a source of compressed air when the power output element is in at least one of its end positions so that the reservoir is recharged.

Other objects and advantages of the present invention will be apparent from the accompanying description and following drawings, which are exemplary, wherein.

Figure 1:
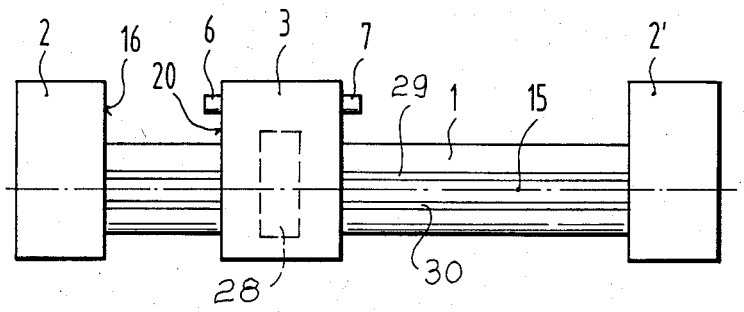
FIG. 1 is a diagrammatic representation of the working cylinder according to the present invention.

Proceeding next to the drawings wherein like reference symbols indicate the same parts throughout the various views, a specific embodiment and modifications of the present invention will be described in detail As may be seen in FIG. 1, the piston rodless working cylinder according to the present invention has a cylindrical body 1 both ends of which are closed by cylinder heads 2 and 2'. A power output element which may be termed a carriage 3 is slidably guided for longitudinal movement on the cylinder body 1. In the cylinder body 1, there is a piston (not shown) which can be acted upon by supplies of compressed air (also not shown) delivered through the cylinder heads 2 or 2'. When the working cylinder is constructed as a band cylinder, the piston is connected to the carriage 3 by steel bands supported by guide rollers in cylinder heads 2, 2' as is conventionally known in such band cylinders. When the working cylinder is constructed as a slotted cylinder, the piston within the cylinder is connected to the carriage 3 by a driver or arm extending through the longitudinal slot in the cylinder body 1 and sealed therein in a manner as also known. As a further modification, the piston can also be connected magnetically in a known manner to the carriage 3 to carry the carriage 3 along during movements of the piston. In each construction, the carriage 3 is provided with an additional or auxilliary device actuated by compressed air which is preferably a brake mechanism 28. This accessory device engages the cylinder body 1 in a manner as already known from the above-mentioned DE-OS No. 34 03 830 and thus need not be explained in further detail. To this extent, the working cylinder corresponds to the prior art.

Figure 2:
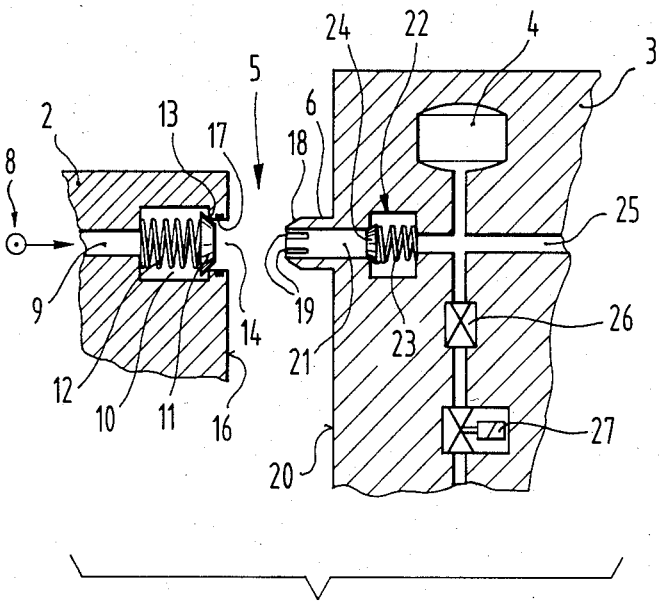
FIG. 2 is a partial sectional view in enlarged scale through the movable carriage and cylinder head to illustrate the coupler structure for coupling the air reservoir on the movable carriage to a source of compressed air.

In the slidable carriage 3, there is a compressed air reservoir 4 which through line coupler devices 5 which includes the tubular coupler members 6 and 7 on the carriage 3 can be connected to compressed air supply devices positioned in the cylinder heads 2 and 2' or connected to them as can be seen in FIG. 2. In FIG. 2, a passage 9 connects to a stationary source of compressed air 8 and the passage 9 enters into a recess 10 in the cylinder head 2. In the recess 10 there is provided a valve element 11 of a cut-off valve 11, 13 which is constructed as a flat valve member and is urged by a spring 12 against a sealing seat 13 in the recess 10 on the carriage side thereof. The sealing seat 13 is rigidly secured in the cylinder head 2. Within the sealing seat 13 there is a cylindrical opening 14 the longitudinal axis of which is parallel to the longitudinal axis 15 of cylinder body 1. The opening 14 extends from recess 10 to a front surface 16 of cylinder head 2 which faces toward the carriage 3. A sealing ring 17 is embedded in the cylindrical wall of the opening 14.

Cylinder head 2' is a mirror image of cylinder 2 and is provided with the same structure described above and need not be described further here.

The carriage 3 is provided with a tubular coupling member 6 which is directed toward a cylinder head 2 and has an outer diameter corresponding to the diameter of opening 18 and ends in a conically tapering outside section 18. Substantially in the area of the outside section 18, the tubular socket 6 has a plurality of radial perforation 19 extending from its free end in the manner of grooves which are uniformly distributed over the periphery of the tubular coupler member 6.

The tubular coupler member 6 projects outwardly beyond front surface 20 of carriage 3 which faces toward cylinder head 2 by a length which is slightly greater than the axial length of the opening 14. This distance is greater than the distance of the sealing ring 13 from front surface 16 of cylinder head 2. In the carriage 3, there is a check valve 22 connected to a passage 21 which is within the tubular coupler member 6. The check valve 22 has a valve member 24 resiliently biased in the closing direction by a spring 23. The check valve 22 opening from inside passage 21 in the direction of flow of air is connected to an air passage or duct 25 in carriage 3 and leads to the compressed air reservoir 4 which is constructed as a hollow chamber in the carriage 3. The air passage 25 also extends in the direction towards cylinder head 2' and is connected to the chamber within the tubular coupling member 7 by a check valve which is the mirror image of the check valve 22 which is not illustrated and need not be described any further.

A brake mechanism 28 on the carriage 3 is constructed as known in the art and accordingly is not further illustrated, but is connected to the air passage 25 through a control valve 27 which is preferably a solenoid valve which in turn is connected to the atmosphere. The power supply and control of solenoid valve 27 is not illustrated in FIGS. 1 and 2 but is described in further detail below.

During the operation of the working cylinder, the carriage 3 on the cylinder body 1 is moved into the position desired in each situation by the corresponding pressure actuation of the piston and thus can be block braked in this position by actuation of the solenoid valve 27. The brake 28 is then actuated with compressed air from the reservoir 4 reduced in its pressure by opening of the relief or pressure reducing valve 26. Prior to any further movement of the carriage 3, the brake 28 is vented to the atmosphere and released by corresponding reversal of the solenoid valve 27. During this positioning action of carriage 3, the check valves 22 on both sides of the carriage 3 are closed and thus shut off the reservoir 4 from the atmosphere existing on the free ends of tubular coupler members 6 and 7. High pressure compressed air supplied from the source 8 exists in cylinder heads 2 and 2' up into the recess 10, but is prevented by the closed valve members 11 on their seats 13 from escaping into the atmosphere to the opening 14.

When the carriage 3 is moved into one of its end positions, for example, the left end position, in which the front surfaces 16 and 17 are spaced only a very short distance from one another or may even be in contact with each other, the tubular coupler member 6 penetrates into the opening 14. This penetration is facilitated by the conical shape 18 on the end of the tubular coupler member. During this penetration of tubular coupler member 6 into opening 14, the sealing ring 17 slides on the outer surface of tubular coupler member 6 in such a manner that the inner chamber 21 of coupler member 6 is sealed off from the atmosphere. When the leading surface of coupler member 6 engages the closed valve member 11, further movement of the coupler member as the carriage 3 moves into its end position will lift the valve member 11 from its seat 13. At this time, high pressure compressed air will flow from recess 10 through perforations 19 into chamber 21 of the tubular coupler member 6 and subsequently through the opening check valve 22 and passage 25 into the reservoir 4 which is then charged to a high pressure so as to replace the compressed air consumed by a previous braking operation. When the carriage 3 is moved to the right from its left end position, all of the components are returned to their positions as shown in FIG. 2. The compressed air stored in the reservoir 4 now enables a number of braking operations from the carriage 3 to be performed.

When the carriage 3 is moved into its right end position, a corresponding operation takes place during which the compressed air storage tank is similarly charged with high pressure compressed air.

The program for controlling the operation of the working cylinder is such that the compressed air stored in the reservoir 4 is more than sufficient for brake actuation. After a predetermined number of brake actuation operations, or maybe even as a function of the pressure prevailing in the reservoir 4 controlled by the pressure in the reservoir falling below a specified level, the control program must function to bring the carriage 3 to one of its two end positions for a recharging of compressed air reservoir 4. By the high pressure charging of reservoir 4 during the actuation of the brake reduced in pressure by pressure reducing valve 26, the result is that many positioning or brake operations for the carriage 3 can be carried out between two successive charging operations for the reservoir 4.

As a modification, the brake mechanism can also engage a separate rail and not the cylinder body 1. In addition, the accessory device on the power output element 3 can be some other form of mechanism other than a brake. The arrangement of the components constituting the coupler 5, particularly the tubular coupling members 6 and 7 and socket openings 14 can be interchanged. Also, the coupler device can be provided on only one side of the carriage 3. The coupler device 5 can also embody other constructions particularly in the opening control of the shut-off valve 11, 13. The structure and operation of this valve can be carried out in numerous other ways but still in accordance with the teachings of this invention.

Figure 3:
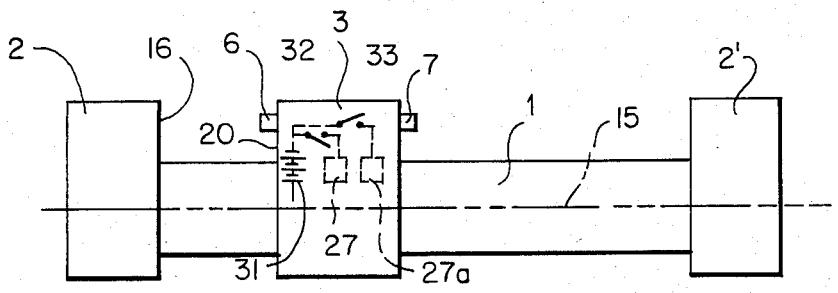
FIG. 3 is a diagrammatic representation of a working cylinder similar to that shown in FIG. 1.

In order to supply electrical power and to control the solenoid valve 27, strip conductors 29, 30 can be mounted on the cylinder body in such a manner as to be insulated from the cylinder body 1 and are contacted by slip rings on the carriage 3. If the working cylinder is constructed of steel band cylinders, it is also possible to guide and support the steel bands in insulated relationship with respect to cylinder body 1 and to supply electric power to the solenoid valve 27 through the steel band and the cylindrical body 1 which is made of an electrically conducted material. It is thus possible to insulate from each other the two opposing steel strips or bands engaging carriage 3 so that three electrical connections to the carriage 3 are achieved by the two steel bands or and cylinder body 1. This will enable carriage 3 to be provided with two solenoid valves strip conductors 29, 30 27 and 27*a* (see FIG. 3) for control, independently of each other, of an additional auxiliary device on the power output element in addition to the brake mechanism which is also operated by compressed air. This additional or auxiliary device can be another working cylinder positioned on the carriage or a gripping device connected to the carriage 3.

In accordance with the teachings of the present invention, it is also possible to mount a battery 31 (see FIG. 3) in the carriage 3 to provide a source of electrical power for the solenoid values 27 and/or 27*a*. To actuate the battery supply, there may be provided a contactless switchable switch 32 respectively 33 which is incorporated in the electrical connection between the battery 31 and solenoid valve 27 respectively 27*a*. The actuators for this switch are adjustably positionable on cylinder body 1 or may be constructed as a special structure positioned close to the cylinder body. The battery 31 may comprise a storage battery which can be charged from a stationary power supply by electrical contacts closed in the end positions of the carriage 3 in a manner somewhat similar to the tubular couplers 5. In each of these constructions, the working cylinder is controlled by the conventional program control wherein the switch actuators can be constructed at the same time to function as location indicators belonging to the control program for the carriage 3.

If several auxiliary or accessory devices are to be operated by compressed air independently of each other, and mounted on the carriage 3, such as when the working cylinder is used in material handling or robotic operations, several solenoid valves 27 may be provided which are controlled by the electrical connections of carriage 3 by a multiplex system.

Thus it can be seen that the present invention has provided a simple but effective structure for the recharging of a movable carriage on a piston rodless working cylinder without employing flexible hose or other direct connections between the movable carriage and a source of compressed air.

It will be understood that this invention is susceptible to modification in order to adapt it to different usages and conditions, and accordingly, it is desired to comprehend such modifications within this invention as may fall within the scope of the appended claims.

What is claimed is:

1. A piston rodless working cylinder comprising a cylinder body having two ends, a pair of cylinder heads each closing one said cylinder body end and each connected to a source of compressed air, a power output element slidable on said cylinder body between end positions adjacent said cylinder heads and having a compressed air driven device thereon adapted for use as a brake mechanism, there being a compressed air reservoir in said power output element, and means on said power output element for automatically connecting said compressed air reservoir to a said source of compressed air when said power output element is in at least one of its end positions so that said compressed air reservoir is recharged.

2. A piston rodless working cylinder as claimed in claim 1 wherein said means comprises a pair of tubular coupler members connectable with said sources of compressed air on said cylinder head, said sources being normally closed on said cylinder heads but open when connected with a said tubular couplar member.

3. A piston rodless working cylinder as claimed in claim 1 and further comprising a pressure relief valve in said power output element between said compressed air reservoir and said compressed air driven device.

4. A piston rodless working cylinder as claimed in claim 1 and further comprising a control valve in said power output element between said compressed air reservoir and said compressed air driven device.

5. A piston rodless working cylinder as claimed in claim 4 wherein said control valve comprises a solenoid valve, and an electric power supply rail on said cylinder body to supply power to said solenoid valve.

6. A piston rodless working cylinder as claimed in claim 5 wherein said power supply rail comprises a metal strip supported insulated from said cylinder body to supply power to said solenoid valve.

7. A piston rodless working cylinder as claimed in claim 5, and further comprising a second solenoid valve and a second metal strip opposed from said first metal strip and supported insulated from said cylinder body to supply power to said second solenoid valve, said cylinder body being metal to define a return for said electric power from both solenoid valves.

8. A piston rodless working cylinder as claimed in claim 4 wherein said control valve comprises a solenoid valve, an electric battery on said power output element connected to said solenoid valve, a contactless switchable switch connected between said battery and said solenoid valve, and adjustably positionable switch actuators on said cylinder body to actuate said switch.

9. A piston rodless working cylinder as claimed in claim 2 wherein said tubular coupler members are on one of said power output element or said cylinder heads, there being a socket opening in the other of said power output element or said cylinder heads to sealingly receive a tubular coupler member in an end position of the power output element to connect to a said source of compressed air, a shut-off valve in said socket opening normally closing said opening and opened when said tubular coupler member is received within said socket opening in an end position, and a check valve normally closing said tubular coupler member and opened when said tubular coupler member is connected to a said source of compressed air to enable compressed air to enter said compressed air reservoir.

10. A piston rodless working cylinder as claimed in claim 9 wherein said tubular coupler members have longitudinal axes parallel to the longitudinal axis of said cylinder body, said tubular coupler members each having a conical end and a plurality of radial openings therein, a sealing ring in each said socket opening and corresponding to the diameter of said tubular coupling member, said shut-off valves each having a valve member which is resiliently closed and opened by said tubular coupler member in an end position of said power output element.

* * * * *